US010872738B2

(12) United States Patent
Comtois et al.

(10) Patent No.: US 10,872,738 B2
(45) Date of Patent: Dec. 22, 2020

(54) ELECTRIC CURRENT SWITCHGEAR

(71) Applicant: Schneider Electric Industries SAS, Rueil Malmaison (FR)

(72) Inventors: Patrick Comtois, Saint-Ismier (FR); Patrick Larcher, Echirolles (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/595,922

(22) Filed: Oct. 8, 2019

(65) Prior Publication Data

US 2020/0126736 A1 Apr. 23, 2020

(30) Foreign Application Priority Data

Oct. 22, 2018 (FR) ..... 18 59735

(51) Int. Cl.
*H01H 3/42* (2006.01)
*H01H 3/46* (2006.01)
(Continued)

(52) U.S. Cl.
CPC ..... *H01H 3/42* (2013.01); *H01H 3/46* (2013.01); *H01H 3/58* (2013.01); *H01H 50/641* (2013.01)

(58) Field of Classification Search
CPC ..... H01H 3/46; H01H 2235/01; H01H 3/38; H01H 3/40; H01H 3/58; H01H 33/42;
(Continued)

(56) References Cited

U.S. PATENT DOCUMENTS 4,470,028 A 9/1984 Vayre et al.
4,893,102 A * 1/1990 Bauer ..... H01H 50/305 335/132
(Continued)

FOREIGN PATENT DOCUMENTS

EP 0 079 819 A1 5/1983
EP 3 333 871 A1 6/2018
WO WO 2006/120149 A1 11/2006

OTHER PUBLICATIONS

French Preliminary Search Report dated Jun. 24, 2019 in French Application 18 59735, filed on Oct. 22, 2018 (with English Translation of Categories of Cited Documents and Written Opinion).

*Primary Examiner* — Ahmed M Saeed
(74) *Attorney, Agent, or Firm* — Oblon, McClelland, Maier & Neustadt, L.L.P.

(57) ABSTRACT

A device for switching an electric current, including a switching block including a mobile electrical contact and a linking unit, integral, as well as an actuation block including an actuator and a mobile pallet. The device includes an improved connection interface, including a pivoting shaft, including an eccentric fastener element, delimiting an internal housing able to accommodate a head of the linking unit. The connection interface can be switched, by rotating the shaft, between a locked state wherein the head of the linking unit is held in the internal housing of the eccentric fastener unit so as to hold the mobile pallet integral in translation with the linking unit, and an unlocked state, wherein the head of the linking unit can move freely in translation with respect to the eccentric fastener element so as to uncouple the mobile pallet from the linking unit.

10 Claims, 6 Drawing Sheets

(51) Int. Cl.
*H01H 3/58* (2006.01)
*H01H 50/64* (2006.01)

(58) Field of Classification Search
CPC .... H01H 2003/323; H01H 3/32; H01H 71/10; H01H 13/20; H01H 50/546; H01H 50/54; H01H 50/14; H01H 50/58; H01H 50/026; H01H 50/047; H01H 50/26; H01H 50/32
See application file for complete search history.

(56) References Cited

U.S. PATENT DOCUMENTS

| | | | | |
|---|---|---|---|---|
| 2008/0185280 | A1 | 8/2008 | Bresciani et al. | |
| 2013/0140153 | A1* | 6/2013 | Larcher | H01H 11/0006 200/50.32 |
| 2014/0262708 | A1* | 9/2014 | Lauraire | H01H 1/2025 200/243 |
| 2015/0318133 | A1* | 11/2015 | Lauraire | H01H 50/64 335/185 |
| 2017/0271095 | A1* | 9/2017 | Larcher | H01F 7/1638 |
| 2018/0166243 | A1 | 6/2018 | Comtois et al. | |

* cited by examiner

ELECTRIC CURRENT SWITCHGEAR

The present invention relates to a device for switching an electric current.

Patent EP 2 936 534 B1 describes a device for switching an electric current, such as a contactor, including a plurality of switching elements with separable contacts, each switching element being associated with a phase of the electric current.

Typically, each switching element includes fixed electrical contacts and a mobile electrical contact movable between open and closed positions so as respectively to prevent or authorize the circulation of the electric current.

So as to move the mobile contacts simultaneously to the same open or closed position, an actuator is coupled with a pallet, mobile in translation, to which the moving contacts are fastened by means of a connection interface. For example, each mobile contact is supported by a contact holder to which a screw head is attached, protruding to the outside and being fastened to the pallet by means of a fork integral with the pallet.

So as to fasten or unfasten the pallet with mobile contacts, it is necessary to move the pallet in translation along a direction different from the direction of translation of the contacts, generally along a vertical direction. When the switching device is already at least partially installed in a switchboard or electrical enclosure, such a translation movement can be difficult to achieve due to lack of space, for example because of the small dimensions of the electrical enclosure or because of the presence of other equipment in the vicinity of the switching device. It is thus difficult to dismantle and/or to reassemble the switching device, which makes installation and maintenance operations more complicated.

There is therefore a need for a device for switching an electric current such as described above, in which the connection interface connecting the mobile contacts to the mobile pallet is improved.

For this purpose, an aspect of the invention relates to a device for switching an electric current, including:

- a switching block with separable contacts including at least one switching element, each switching element comprising a fixed electrical contact, a mobile electrical contact movable in translation with respect to the fixed electrical contacts between a closed position and an open position, and a linking unit integral in translation with the mobile electrical contact;
- an actuation block including an actuator and a mobile pallet coupled with the actuator.

According to the invention, the switching device furthermore includes a connection interface inserted between the switching block and the actuation block, the connection interface including a shaft and a structure integral in translation supporting the mobile pallet, the shaft being assembled pivoting around its longitudinal axis with respect to the support structure, the shaft including at least one eccentric fastener element, each eccentric fastener element delimiting an internal housing able to accommodate a head of one of the linking units, the connection interface being switchable, by rotation of its shaft around its longitudinal axis, between:

- a locked state, in which the head of each linking unit is held inside the internal housing of one of the eccentric fastener elements so as to hold the mobile pallet integral in translation with each linking unit, and
- an unlocked state, in which the head of each linking unit can move freely in translation with respect to said eccentric fastener element so as to uncouple the mobile pallet from each linking unit.

Thanks to the invention, the connection and the locking between the mobile pallet and each mobile part are achieved by making the shaft turn and without resorting to a translation movement susceptible of being impeded by equipment or obstacles situated close to the switching device.

According to advantageous but not obligatory aspects, such a switching device can incorporate one or more of the following characteristics, taken in isolation or according to any technically admissible combination:

- Each eccentric fastener element has a cylindrical shape centred on the longitudinal axis, the internal housing being delimited at least in part by a side wall parallel to the longitudinal axis and comprising a first opening and a second opening, the width of the first opening being strictly less than the width of the second opening, the first and second openings being adjacent and forming a continuous opening of variable width, the width of the second opening being greater than the largest width of the head of the linking unit, the width of the first opening being less than the largest width of the head of the linking element, while, in the locked state, each first opening is aligned with and placed opposite a linking unit and while, in the unlocked state, each second opening is aligned with and placed opposite a linking unit.
- The shaft includes at least one control portion placed at one end of the shaft so as to turn the shaft around its longitudinal axis, the control portion being able to cooperate by complementarity of shape with a tool.
- The control portion includes an imprint formed on an end surface of the shaft perpendicular to the longitudinal axis, for example an imprint having a slot shape, or a cruciate shape, or a polygon shape.
- The connection interface includes a maneuvering device including a manual control unit coupled with the shaft so as to turn the shaft around its longitudinal axis.
- The manual control unit is a pivoting lever assembled on a side face of a casing of the connection interface.
- The head of the linking unit has a spherical shape.
- The head of the linking unit has flat side faces.
- The shaft is a single piece.
- The shaft is made in a metal material, for example in Zamak alloy.

The invention will be better understood and other advantages of same will emerge more clearly in the light of the description that will follow of an embodiment of a device for switching an electric current, description given only as an example and made with reference to the attached drawings, in which.

Figure 1:
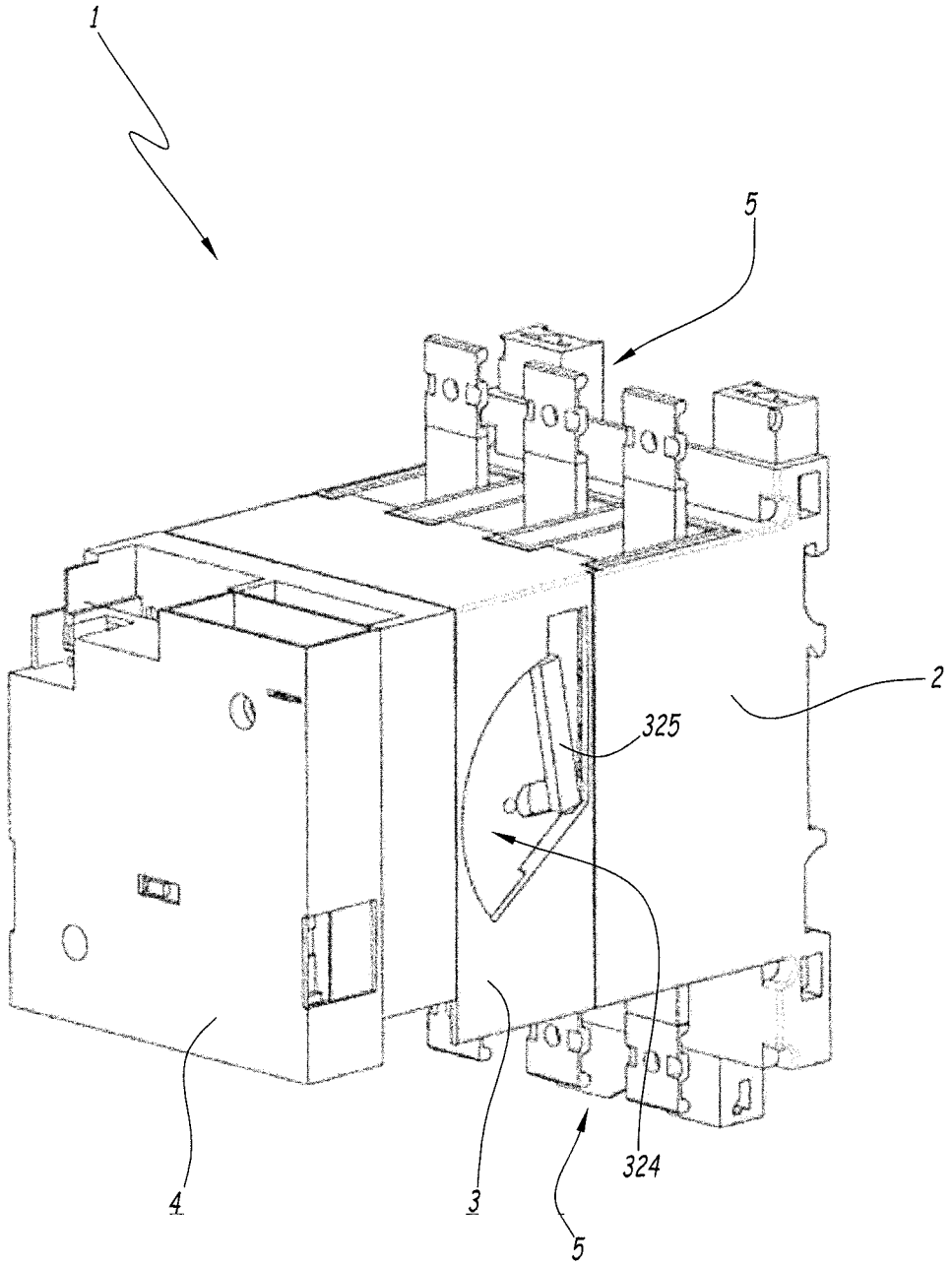
FIG. 1 is a schematic illustration of a device for switching an electric current according to embodiments of the invention.

FIG. 1 illustrates a device 1 for switching an electric current, such as a contactor. The switching device 1 is particularly suitable for interrupting, or alternatively, for authorizing the circulation of an electric current, for example in response to a control signal. According to examples, the switching device 1 is intended to be connected in an electrical power supply installation.

According to implementation methods, the device 1 includes a switching block 2, a connection interface 3, an actuation block 4 and upstream and downstream electrical connection terminals 5.

The switching block 2 includes separable contacts housed in one or more individual switching elements. The electrical contacts are movable between open and closed positions, respectively for interrupting or authorizing the circulation of the electric current between the connection terminals 5.

The connection interface 3 is assembled between the actuation block 4 and the switching block 2 for the purpose of allowing an actuator of the actuation block 4 to move the separable contacts of the switching block 2 between the open and closed positions.

Figure 2:
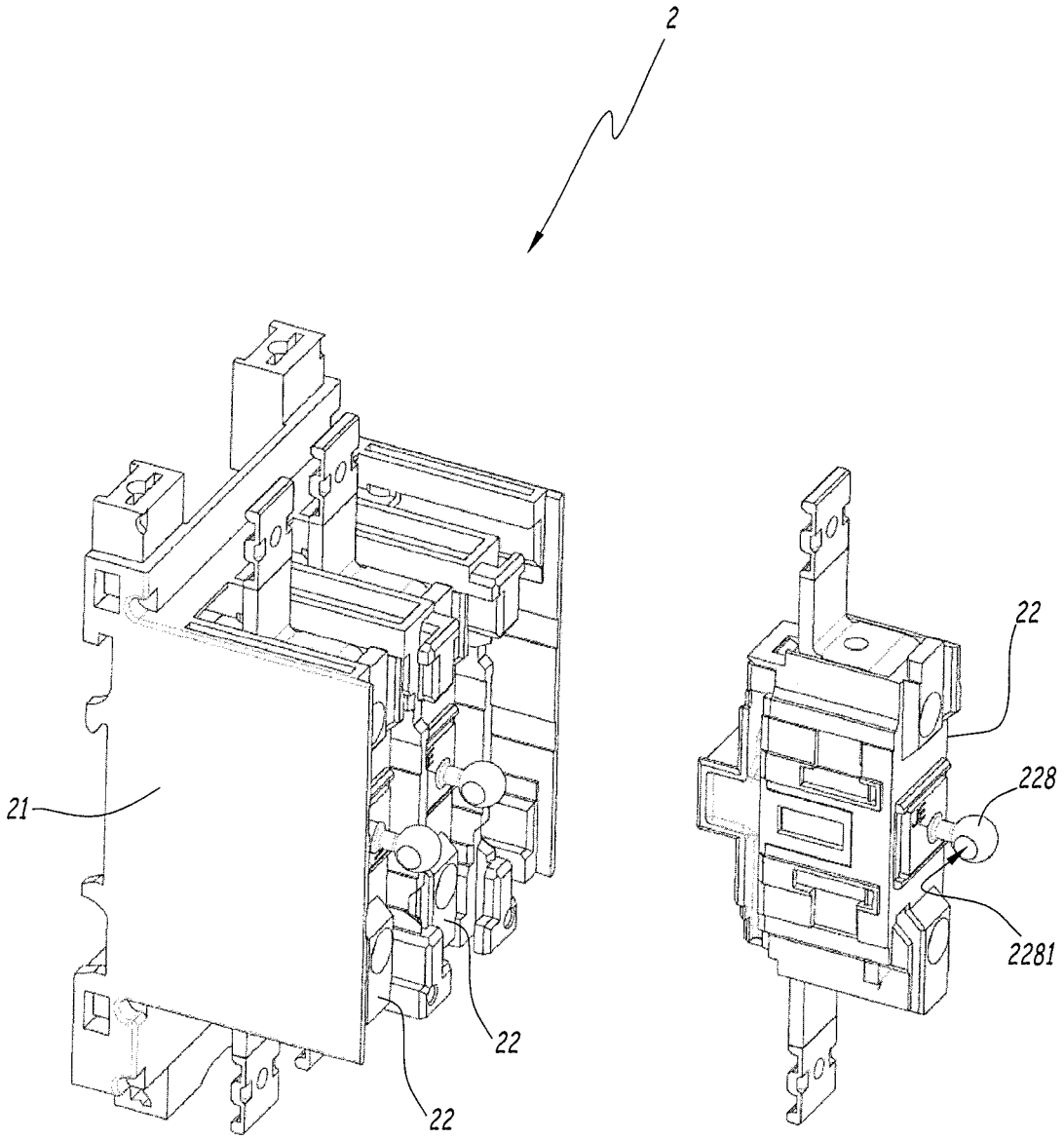
FIG. 2 is a schematic illustration along a partially exploded view of a switching block of the switching device of FIG. 1.

As illustrated on FIG. 2, the switching block 2 includes a baseplate 21 and at least one switching element 22, each switching element 22 being associated with a phase of the electric current.

For example, each switching element 22 is removably accommodated in a housing defined by the baseplate 21. For example, the baseplate 21 is fastened to an electric panel when the switching device 1 is in assembled configuration.

According to embodiments, the switching device 1 is a multipole device suitable for interrupting a polyphase current, in particular a three-phase current, and includes for this purpose a plurality of switching elements 22, preferably identical, accommodated in the baseplate 21.

In the illustrated example, the switching device 1 includes three switching elements 22. As a variant, the number of switching elements 22 can be different, for example four in number in the case of a three-phase current with neutral.

Figure 4:
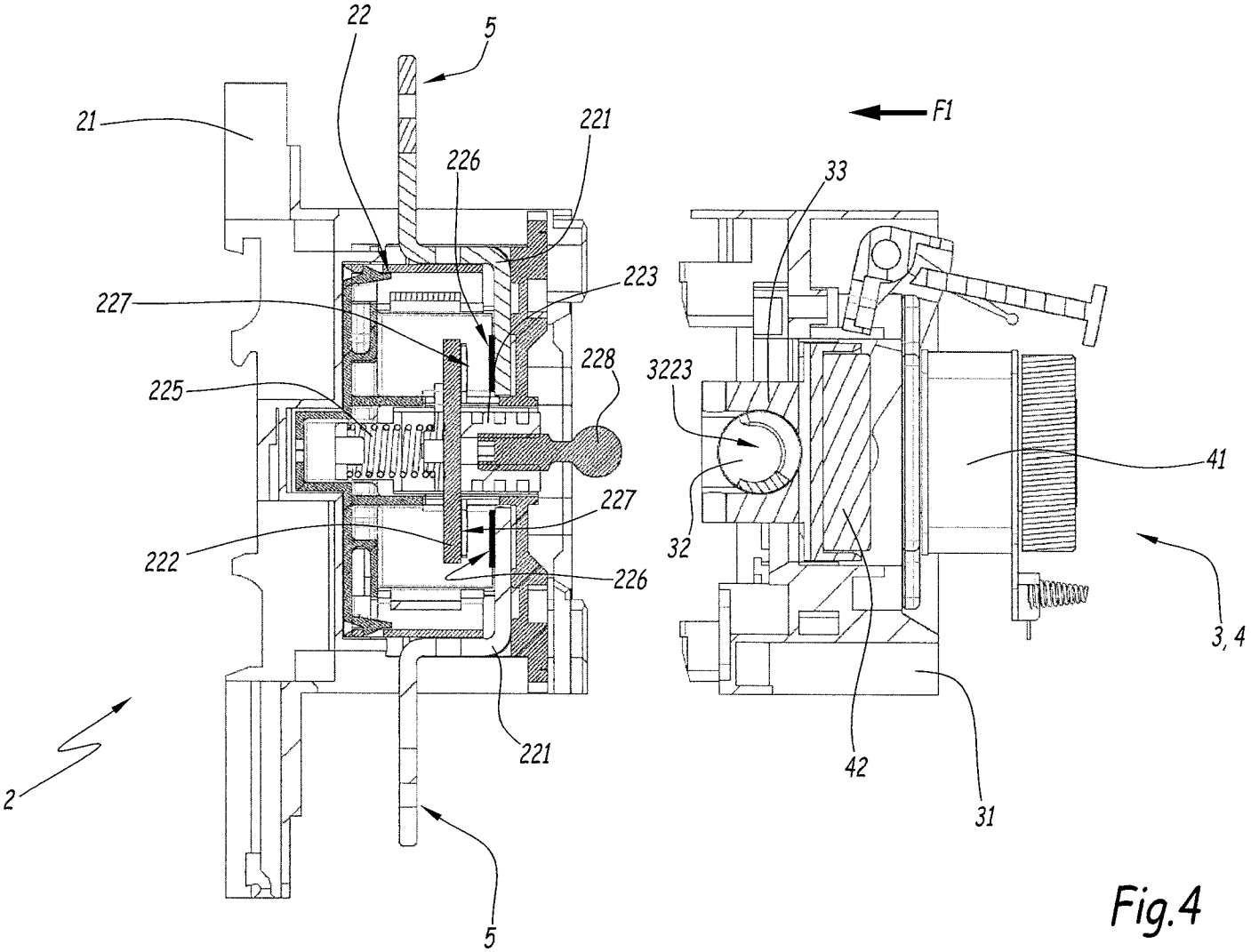
FIGS. 4 to 6 are sectional views of the switching device of FIG. 1 illustrating a switching of the connection interface of FIG. 2 to a locked state.

As is visible on FIG. 4, each switching element 22 includes two fixed electrical contacts 221 and one mobile electrical contact 222.

The fixed contacts 221 are electrically connected respectively to the upstream and downstream connection terminals 5. The mobile contact 222 is movable with respect to the fixed contacts 221, here by translation along a direction of movement, between the open position and the closed position.

According to embodiments, the mobile contact 222 is integral with a mobile bridge 223 movable in translation with respect to a body 224 fastened to a casing of the switching element 22.

For example, each switching element 22 also includes an elastic return unit 225, such as a coil spring, which exerts pressure on the mobile contact 222 in the direction of the fixed contacts 221 so as to accentuate the electrical contact between fixed contacts 221 and mobile contact 222 when these fixed contacts 221 and this mobile contact 222 are in the closed position.

Each fixed contact 221 includes a contact pad 226 in electrically conducting material. Correspondingly, the mobile contact 222 includes contact pads 227 disposed opposite the contact pads 226. In the closed position, the pads 226 and 227 are placed in contact, allowing the electric current to pass between the upstream and downstream fixed contacts 221.

Each switching element 22 also includes a linking unit 228 integral in translation with the mobile bridge 223 and making it possible mechanically to connect the mobile bridge 223 with the actuation block 4, as described in the following.

According to examples, the linking unit 228 extends protruding on a front face of the switching element 22. The linking element 228 here includes a head, spherical in shape for example, and a body extending longitudinally from a base of the head to the mobile bridge 223 and forming a junction portion. In particular, the maximum width of the longitudinal body is less than the largest width of the head of the linking unit 228.

For example, each linking unit 228 is made in plastic material, for example in moulded plastic.

Figure 3:
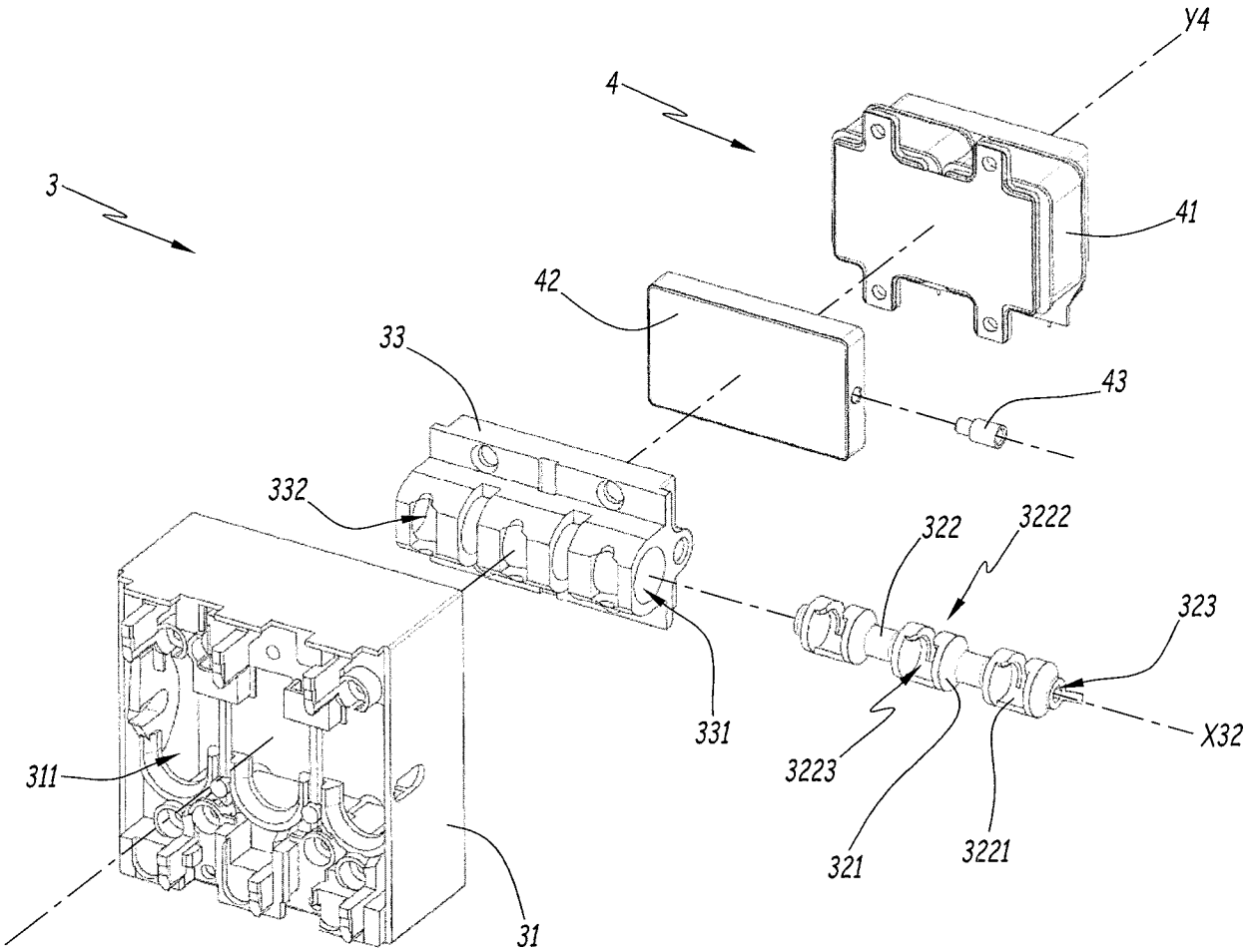
FIG. 3 is a schematic illustration along a partially exploded view of an actuator and a connection interface of the switching device of FIG. 1.

As illustrated on FIG. 3, the actuation block 4 includes an actuator 41 and a mobile pallet 42. So as to facilitate reading FIG. 3, only a part of the actuation block 4 is illustrated.

The actuator 41 is arranged reversibly to move the mobile pallet 42 in translation along a longitudinal axis Y4. When the switching device 1 is in an assembled configuration, the longitudinal axis Y4 is parallel to the direction of movement of the mobile contacts 222 and extends between the front and the back of the device 1.

According to examples, the actuator 41 includes an electromagnet and the mobile pallet 42 includes a magnetic material, for example a ferromagnetic material.

According to embodiments, the interface 3 includes a casing 31 permanently assembled on a front face of the switching block 2, for example by being connected permanently to the baseplate 21. In assembled configuration, the actuation block 4 is fastened on a front face of the interface 3 integral with the casing 31.

As illustrated on FIG. 3, the casing 31 here includes through openings 331, each disposed opposite one of the switching elements 22.

The interface 3 also includes a shaft 32 extending along a longitudinal axis X32 and a support structure 33 accommodating the shaft 32. When the device 1 is in assembled configuration, the axis X32 is perpendicular to the axis Y4. For example the axis X32 is horizontally oriented. The shaft 32 here is rotationally assembled with respect to the support structure 33.

According to implementation methods, the support structure 33 defines a housing 331 for accommodating the shaft 32. For example, the housing 331 has a cylindrical or tubular cavity shape extending along the axis X32 whose opposite ends form openings that allow access to ends 323 of the shaft 32.

In assembled configuration, the support structure 33 is integral with the mobile pallet 42. For example, the mobile pallet 42 is coupled with the support structure 33 by means of a mechanical device of which only one element 43 is visible on FIG. 3.

The support structure 33 also includes windows 332 arranged on a back face and which emerge towards the inside of the housing 331. In assembled configuration, the windows 332 are aligned with the openings 311 of the casing 31 and are thus aligned with the switching elements 22, preferably aligned with the linking units 228 along the direction of movement, so as to authorize the passage of the linking units 228 through the windows 332 and openings 311.

The shaft 32 includes eccentric fastener elements 321, each intended to be associated with a linking unit 228. It is therefore understood that the shaft 32 here includes as many fastener elements 321 as switching elements 22. The fastener elements 321 are aligned along the axis X32.

For example, each fastener element 321 has a cylindrical shape centred on the axis X32 and defines an internal housing delimited by bottom walls perpendicular to the axis X32 and delimited at least in part by a side wall 3221 parallel to the axis X32, the side wall connecting the two opposite bottom walls.

Each fastener element 321 includes a first opening 3222 and a second opening 3223. The openings 3222 and 3223 are each formed in the side wall 3221 and describe a circular arc centred around the axis X32.

Preferably, the fastener elements 321 are identical and the respective openings 3222 and 3223 of the fastener elements 321 are aligned together.

The shaft 32 also includes connection portions 322, for example rod or cylinder in shape, aligned along the axis X32, which connect the fastener elements 321 two by two. For example, each connection portion 322 connects two directly adjacent fastener elements 321 by their bottom walls facing each other.

The first opening 3222 has a width strictly less than the width of the second opening 3223. The widths of the first and second openings are measured here parallel to the axis X32.

The openings 3222 and 3223 are adjacent and thus form a continuous opening of variable width extending at least over a part of the circumference of the side wall 3221.

For example, the width of the second opening 3223 is greater than the largest width of the head of the linking unit 228, that is to say here the diameter of the head of the linking unit 228. The width of the first opening 3222 is less than said largest width of the linking unit 228, but greater than the largest width of the connection portion of the linking unit 228.

In the assembled configuration of the interface 3, the shaft 32 is movable, by rotation around the axis X32, between a first position and a second position.

In the first position, the second opening 3223 is aligned with the window 332 with which the fastener element 321 is associated, which authorizes the insertion of the linking unit 228 into the housing defined by said fastener element 321.

In particular, the head of the linking unit 228 can then be fully inserted into said housing. In other words, the head of each linking unit 228 can move freely in translation with respect to said fastener element 321 so as to uncouple the mobile pallet 42 from each linking unit 228. In other words, the head of the linking unit is held inside the internal housing. This first position corresponds to an unlocked state of the interface 3.

It is understood in particular that the heads of the linking units 228 here are aligned along an axis parallel to the axis X32.

In the second position, the first opening 3222 is aligned with said window 332, which prevents the insertion of the linking unit 228 into said housing, or, on the contrary, prevents the withdrawal of the linking unit 228 from the housing defined by said fastener element 321, since the width of the first opening is less than the largest width of the head of the linking unit 228. This second position corresponds to a locked state of the interface 3.

In other words, thanks to the association of the fastener elements 321 and the linking units 228, the connection interface 3 is switchable between a locked state and an unlocked state.

In the locked state, the support structure 33 and the mobile pallet 42 are integral in translation with the mobile bridges 223 of the switching elements 22. The mobile contacts 222 can thus be moved by the actuator 41 between the open position and the closed position.

In the unlocked state, the support structure 33 and the mobile pallet 42 are uncoupled from the mobile bridges 223 of the switching elements 22. The actuator 41 is thus no longer able to move the mobile contacts 222 between the open position and the closed position.

According to embodiments, as illustrated on FIG. 3, the shaft 32 includes at least one control portion 323 placed at one end of the shaft 32 and allowing an operator to turn the shaft 32 between the first position and the second position around the longitudinal axis X32. For example, the control portion 323 is able to cooperate by complementarity of shape with a tool such as screwdriver or a spanner.

According to implementations, the control portion 323 includes an imprint formed on an end surface of the shaft 32 perpendicular to the axis X32 and having a slot shape, or a cruciate shape, or a polygon shape or any other similar shape.

In practice, the control portion 323 is accessible from the outside of the casing 31, thanks here to an opening arranged in a side wall of the casing 31, which allows the shank of the tool to be inserted.

According to variants, each end of the shaft 32 is provided with such a control portion 323.

According to other embodiments, as illustrated on FIG. 1, the connection interface 3 includes a maneuvering device 324 including a manual control unit 325, such as a pivoting lever, coupled with the shaft 32 or with a control portion 323 of the shaft 32 so as to turn the shaft 32 around its longitudinal axis X32. The unit 325 is assembled on a side face of the casing 31.

This allows an operator easily to switch the shaft 32 between the first position and the second position without needing to use a specific tool. This also makes it possible visually to indicate to the operator the position in which the shaft 32 is located and therefore to know if the interface 3 is in the locked state or the unlocked state.

According to examples, the shaft 32 is made in a metal material, for example in Zamak alloy.

As a variant, the shaft 32 is made for example in plastic material.

In order to avoid electrical triggering among the phases, if the shaft 32 is made in electrically conducting material, for example the abovementioned metal material, it is preferably provided that the linking unit 228 is made in electrically insulating material, for example in plastic material as mentioned above. Conversely, if the unit 228 is made in electrically conducting material, for example a metal material, it is preferably provided that the shaft 32 is made in electrically insulating material, such as a plastic material.

As shown on FIG. 3, between each successive element 321, the shaft 32 has a diameter reduction, each reduction accommodating an interphase partition formed by the support structure 33 in an aim for interphase electrical insulation. Each interphase partition forms a portion of one of the windows 332.

For example, the shaft 32 is single piece, that is to say that the fastener elements 321 are formed here in a single piece with the connection portions 322 and the control portions 323.

An example of functioning in order to lock the connection interface 3 is now described with reference to FIGS. 4 to 6.

Initially, as illustrated on FIG. 4, the interface 3 is in assembled configuration with the actuation block 4, while being separate from the switching block 2. The shaft 32 is in the first position.

The interface 3 is then translated towards the switching block 2, here following the direction of movement illustrated by the arrow F1, along the direction of movement, until the head of each linking unit 228 of each of the switching elements 22 is accommodated in the housing delimited by the corresponding fastener element 321 after having passed through the second opening 3223 of this fastener element 321.

Figure 5:
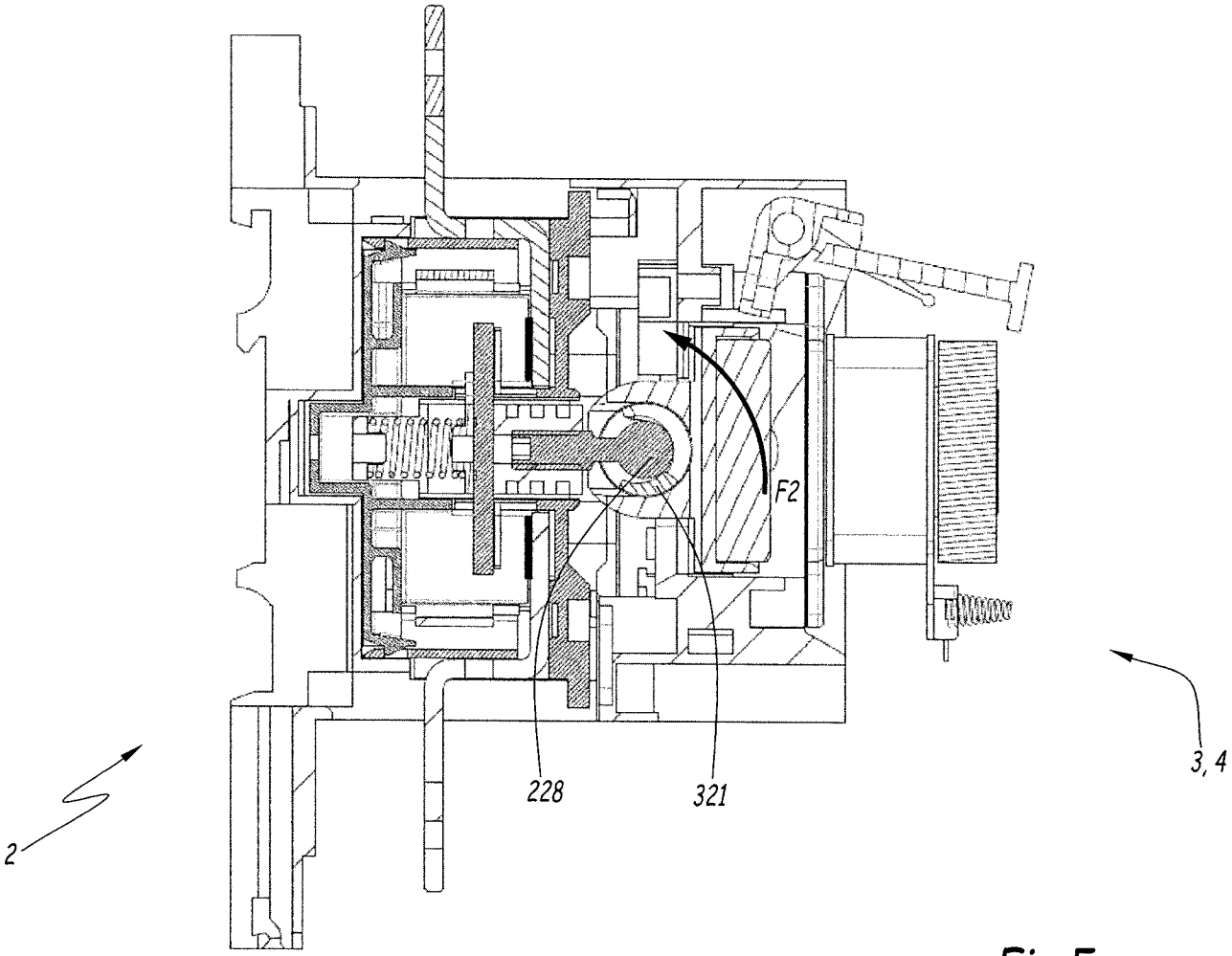

At this stage, the casing 31 is in contact with the baseplate 21, as shown on FIG. 5, and can then be fastened to the baseplate 21. The switching device 1 is then in its assembled configuration.

The interface 3 is still in the unlocked state, such that a movement of the mobile pallet 42 by the actuator 41 does not induce any movement of the mobile contacts 222 between the open and closed positions.

The shaft 32 is then turned to its second position, for example by means of the control portion 323 and/or of the lever 325, in the direction illustrated by the arrow F2.

Figure 6:
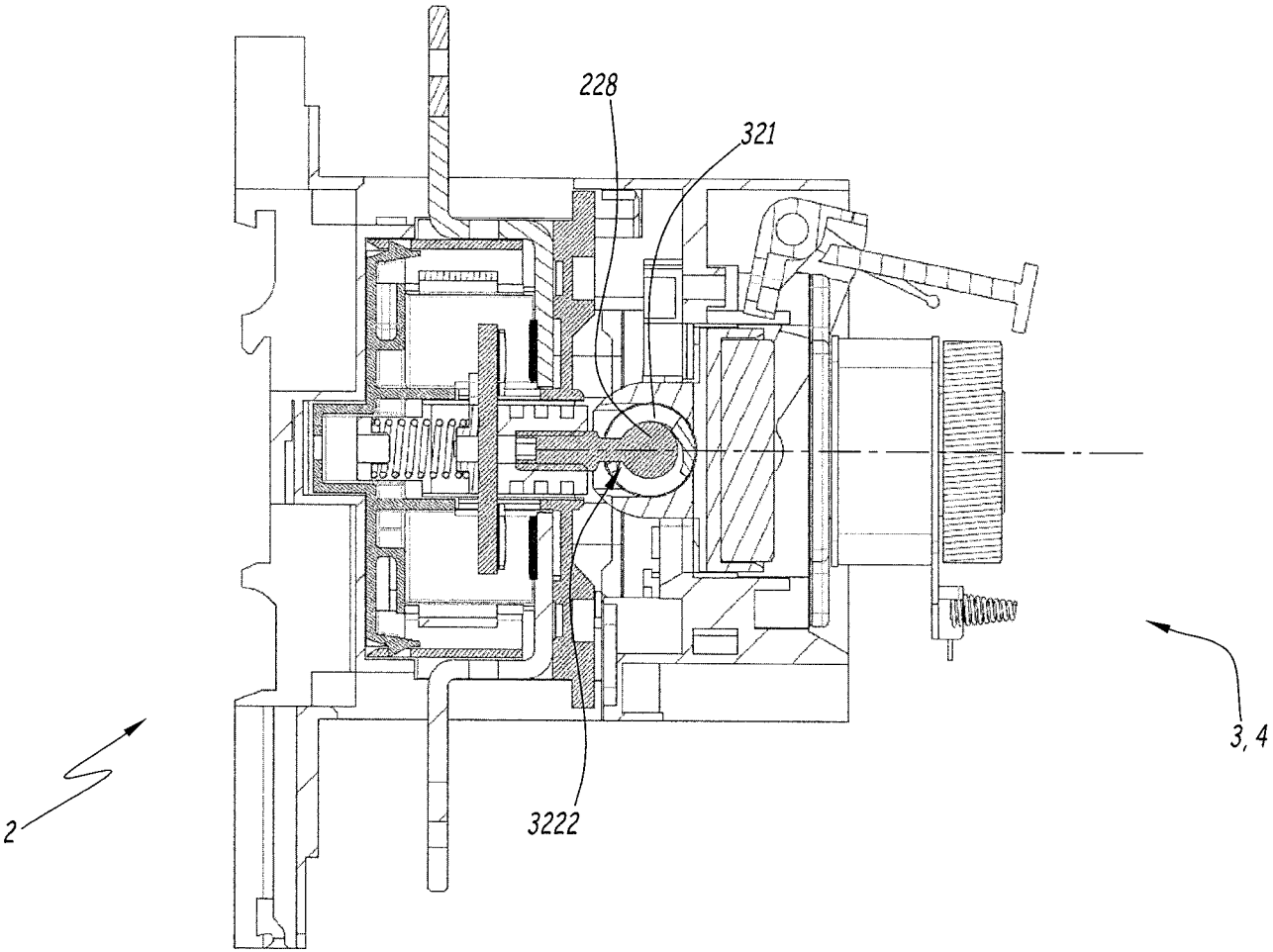

After the shaft 32 has rotated, this stage, as illustrated on FIG. 6, the head of the linking unit 228 is prevented from leaving the housing delimited by the fastener element 321 during a translation along the direction of movement, in particular because the first opening 3222 has a width less than the width of the head of the linking unit 228.

Each fastener element 321 is preferably jammed onto the head of the associated linking unit 228, so as to prevent any accidental uncoupling of these elements during functioning, in particular under the effect of vibration.

A link without play is preferably ensured between each unit 228 and its respective fastener element 321, in particular by implementing materials having a certain elasticity, and/or by tools of complementary shapes.

The interface 3 is in the locked state, such that any movement of the mobile pallet 42 in translation along the axis of movement causes a corresponding movement of the mobile contacts 222 between the open and closed positions.

The interface 3 makes it possible to reduce the space needed for assembling and coupling the actuation block 4 with the switching block 2 when installing the device 1, since it is no longer necessary to move the mobile pallet 42 in vertical translation in order to fasten it to the linking units 228. On the contrary, as explained previously, locking is obtained by turning the shaft 32 after having positioned the interface 3 in contact with the switching block 2 by translation along the direction of movement.

Similarly, unlocking and dismantling the actuation block and the switching block 2 are also simplified, since unlocking is obtained simply by turning the shaft 32 in the opposite direction.

Furthermore, the connection interface 3 can remain in the unlocked state even when it is assembled on the switching block 2. This allows an operator to power up the actuator 41 and move the mobile pallet 42, for example to perform tests of the device 1 in real conditions, without necessarily setting the mobile contacts 222 in motion. The risks of electrical accidents are thus reduced.

According to optional embodiments, as illustrated on FIG. 2, the spherical head of the linking unit 228 includes flat side faces 2281 in the shape of flat spots. This makes it possible to reduce the width of the openings 311 and the windows 332 and therefore to reduce the lateral size of the device 1. In this case, the largest width of the head of the linking unit 228 is measured between the flat side faces 2281.

According to variants, not illustrated, the linking unit 228 can have a different shape, for example a valve shape or a screw shape with a flat head.

The embodiments and the variants envisaged above can be combined together to give rise to new embodiments.

The invention claimed is:

1. A device for switching an electric current, comprising:

a switching block with separable contacts including at least one switching element, each switching element comprising a fixed electrical contact, a mobile electrical contact movable in translation with respect to the fixed electrical contacts between a closed position and an open position, and a linking unit integral in translation with the mobile electrical contact;

an actuation block including an actuator and a mobile pallet coupled with the actuator;

wherein the device for switching the electric current comprises a connection interface inserted between the switching block and the actuation block, the connection interface including a shaft and a support structure integral in translation supporting the mobile pallet, the shaft being assembled pivoting around g longitudinal axis thereof with respect to the support structure, the shaft including at least one eccentric fastener element, each eccentric fastener element delimiting an internal housing able to accommodate a head of one of the linking units, the connection interface being switchable, by rotation of the shaft around g longitudinal axis thereof, between:

a locked state, wherein the head of each linking unit is held inside the internal housing of one of the eccentric fastener elements so as to hold the mobile pallet integral in translation with each linking unit, and an unlocked state, wherein the head of each linking unit can move freely in translation with respect to said eccentric fastener element so as to uncouple the mobile pallet from each linking unit.

2. The switching device according to claim 1, wherein each eccentric fastener element has a cylindrical shape centred on the longitudinal axis, the internal housing being delimited at least in part by a side wall parallel to the longitudinal axis and comprising a first opening and a second opening, g width of the first opening being strictly less than the width of the second opening, the first and second openings being adjacent and forming a continuous opening of variable width, a width of the second opening being greater than a largest width of the head of the linking unit, the width of the first opening being less than the largest width of the head of the linking unit, and wherein, in the locked state, each first opening is aligned with and placed opposite a linking unit and wherein, in the unlocked state, each second opening is aligned with and placed opposite a linking unit.

3. The switching device according to claim 1, wherein the shaft includes at least one control portion placed at one end of the shaft so as to turn the shaft around a longitudinal axis thereof, the control portion being able to cooperate by complementarity of shape with a tool.

4. The switching device according to claim 1, wherein the control portion includes an imprint formed on an end surface of the shaft perpendicular to the longitudinal axis, the imprint having a slot shape, or a cruciate shape, or a polygon shape.

5. The switching device according to claim 1, wherein the connection interface includes a maneuvering device including a manual control unit coupled with the shaft so as to turn the shaft around a longitudinal axis thereof.

6. The switching device according to claim 5, wherein the manual control unit is a pivoting lever assembled on a side face of a casing of the connection interface.

7. The switching device according to claim 1, wherein the head of the linking unit has a spherical shape.

8. The switching device according to claim 7, wherein the head of the linking unit has flat side faces.

9. The switching device according to claim 1, wherein the shaft is a single piece.

10. The switching device according to claim 1, wherein the shaft is made in a metal material comprising a Zamak alloy.

* * * * *